US007905192B1

(12) United States Patent
Hertel, III

(10) Patent No.: US 7,905,192 B1
(45) Date of Patent: Mar. 15, 2011

(54) INTEGRATED UNDERWATER SURFACE CLEANING AND EFFLUENT TREATMENT SYSTEM

(75) Inventor: William Martin Hertel, III, Annapolis, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 436 days.

(21) Appl. No.: 11/998,989

(22) Filed: Nov. 5, 2007

Related U.S. Application Data

(60) Provisional application No. 60/856,473, filed on Nov. 3, 2006.

(51) Int. Cl.
*B63B 59/00* (2006.01)

(52) U.S. Cl. ..... 114/222

(58) Field of Classification Search ..... 114/222
See application file for complete search history.

(56) References Cited

U.S. PATENT DOCUMENTS

| | | | | |
|---|---|---|---|---|
| 3,664,951 | A * | 5/1972 | Armstrong | 210/707 |
| 4,153,558 | A | 5/1979 | Frykhult | |
| 4,401,048 | A | 8/1983 | Rogers | |
| 5,437,794 | A | 8/1995 | Andersson | |
| 5,628,271 | A | 5/1997 | McGuire | |
| 5,947,051 | A | 9/1999 | Geiger | |
| 6,189,473 | B1 * | 2/2001 | Appel et al. | 114/222 |
| 6,209,473 | B1 * | 4/2001 | Jones et al. | 114/222 |
| 6,595,152 | B2 | 7/2003 | McGuire | |
| 7,416,668 | B1 * | 8/2008 | Theodore | 210/603 |
| 2006/0000784 | A1 * | 1/2006 | Khudenko | 210/748 |

* cited by examiner

*Primary Examiner* — Daniel V Venne
(74) *Attorney, Agent, or Firm* — Dave A. Ghatt

(57) ABSTRACT

A method and apparatus for the cleaning of an underwater surface, such as a ship hull. The method and apparatus enables cleaning to be conducted while mitigating the release of removed material into surrounding waters. The integrated apparatus includes a cleaning vehicle for removing fouling from the underwater hull surface, and a land treatment unit for treating liquid waste that is conveyed to the land treatment unit from the cleaning vehicle. The cleaning vehicle may include a pre-processing unit that pre-treats substances removed during the cleaning process.

8 Claims, 9 Drawing Sheets

INTEGRATED UNDERWATER SURFACE CLEANING AND EFFLUENT TREATMENT SYSTEM

CROSS-REFERENCE TO RELATED APPLICATIONS

This application claims the benefit of U.S. Provisional Application No. 60/856,473 filed Nov. 3, 2006, which is incorporated herein by reference.

This application is related to U.S. Non-Provisional patent application Ser. No. 11/998,978, filed Nov. 5, 2007, entitled "Underwater Surface Cleaning Vehicle For Integrated Cleaning and Effluent Treatment System", which is based on U.S. Provisional Application No. 60/856,472, filing date Nov. 3, 2006, hereby incorporated herein by reference.

STATEMENT OF GOVERNMENT INTEREST

The following description was made in the performance of official duties by employees of the Department of the Navy, and, thus the claimed invention may be manufactured, used, licensed by or for the United States Government for governmental purposes without the payment of any royalties thereon.

TECHNICAL FIELD

The following description relates generally to a method and apparatus for underwater hull cleaning, and in particular to an integrated underwater hull cleaning and effluent treatment process.

BACKGROUND

Navy ships are periodically cleaned using open cycle cleaning devices such as, for example, submerged cleaning and maintenance platform (SCAMP) technology that utilizes integrated impeller and cleaning brush technology and results in the direct discharge of removed constituents such as, for example, biological fouling, hull coatings, and corrosion byproducts into surrounding water. Most antifouling coatings utilize heavy metals such as Cu and Zn as biocides that are released during cleaning operations at levels that can exceed water quality criteria. This has prompted governments to develop standards to manage this discharge or, in some cases, to prohibit open water cleaning of hulls with coatings that have antifoulants in them without special permission.

Waterborne underwater hull cleaning is critical to the worldwide operation and maintenance of Navy ships and impacts operating capability (e.g., speed and maneuverability), acoustic signature, fuel efficiency and the maintainability and lifecycle of critical systems including underwater hull coatings, impress current cathodic protection systems, and propulsion systems.

SUMMARY

Disclosed are systems and techniques for conducting integrated waterborne underwater hull cleaning using successive onboard vehicle processing and working fluid reuse with shore or pierside treatment of concentrated contaminants, including heavy metal toxicants in antifouling paint, with subsequent management and disposal of the wastestream by existing infrastructure.

In one aspect, the invention is an integrated hull cleaning and treatment system. The system includes a cleaning vehicle for removing fouling from an underwater hull surface of a docked watercraft and for drawing water entrained material away from the cleaning region. The system further includes a land treatment unit for treating liquid waste received from the cleaning vehicle and converting the liquid waste into dewatered solids and treated effluents. According to the invention, the land treatment unit has a gravity settling unit, a chemical treatment unit, a gravity thickening unit, and a land intake port for receiving the liquid waste from the cleaning vehicle. In this aspect, the invention includes a land intake hose having a first end and a second end, the first end attached to the cleaning vehicle and the second end attached to the land intake port of the treatment unit.

In another aspect, the invention is an environmentally friendly method of cleaning an underwater hull surface using an integrated hull cleaning and treatment system. According to this method, the system includes a cleaning vehicle, a land treatment unit, and a flexible intake hose attached at one end to the cleaning vehicle and at another end to the land treatment unit. In this aspect, the method includes, removing, with the cleaning vehicle, fouling material from an underwater hull surface of a docked watercraft, and drawing through the cleaning vehicle, a particulate flow of water entrained material removed from the cleaning region. The method further includes, conveying, via the flexible intake hose, liquid waste from the cleaning vehicle to the land treatment unit, and converting, in the land treatment unit, the liquid waste into dewatered solids and treated effluents.

In another aspect, the invention is a cleaning vehicle for cleaning an underwater surface, the cleaning vehicle having a cleaning deck. In this aspect, the cleaning deck includes a deck mouth, and one or more circulation pumps downstream of the deck mouth for initiating cleaning deck suction onto the underwater surface and for initiating a particulate flow of water entrained material removed by the cleaning deck. The invention also includes one or more abrasion devices for removing fouling from the underwater surface. The cleaning vehicle further includes a discharge port for discharging the particulate flow of water entrained material to a remotely located treatment unit.

Other objects, features, and advantages will be apparent from the description, the drawings, and the claims.

DETAILED DESCRIPTION

An integrated waterborne underwater hull cleaning system incorporates successive onboard vehicle processing and working fluid reuse with integrated treatment of concentrated contaminants, including metal toxicants in antifouling paint, and subsequent management and disposal of the wastestream by existing infrastructure.

Figure 1A:
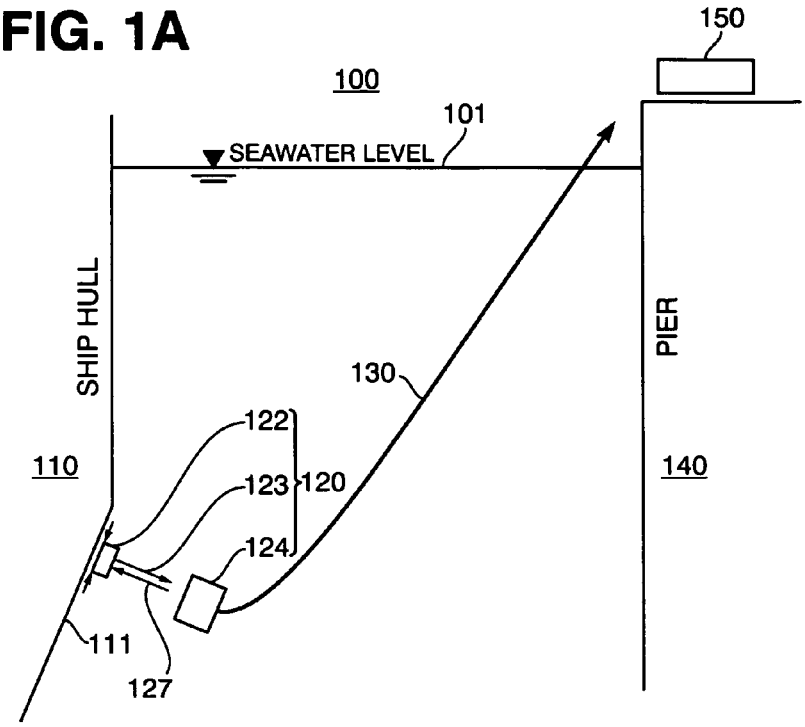
FIG. 1A is an exemplary flow diagram of an integrated hull cleaning and effluent treatment system according to an embodiment of the invention.
Figure 1B:
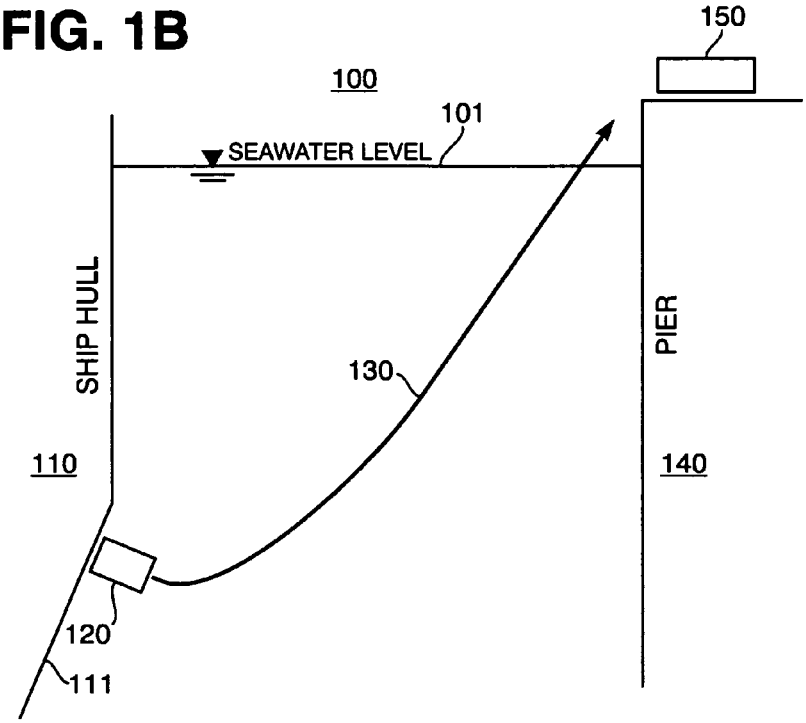
FIG. 1B is an exemplary flow diagram of an integrated hull cleaning and effluent treatment system according to an embodiment of the invention.

Disclosed is an integrated waterborne underwater hull cleaning and integrated effluent treatment process that mitigates the release of removed constituents to surrounding waters. FIGS. 1A and 1B are exemplary flow diagrams of an integrated hull cleaning and effluent treatment system 100 for performing the above-recited functions. As illustrated in FIGS. 1A and 1B, the system 100 includes a ship hull 110 having a hull surface 111, the ship hull docked in relatively close proximity to a pier 140. The system 100 further includes a cleaning vehicle 120. As shown in FIG. 1A, the system 100 may include a cleaning vehicle 120 that both cleans and treats cleaning effluents. FIG. 1B shows an embodiment in which the vehicle 120 cleans but does not directly treat cleaning effluents.

FIG. 1A shows the cleaning vehicle 120 having a cleaning deck or shroud 122 and a pre-processing deck 124. The cleaning deck 122 moves across the hull surface 111 to physically remove fouling and other undesired buildups from hull surface. The pre-processing deck 124, via a reduced pressure gradient, sucks the particulate flow of removed fouling material and other cleaning material such as antifoulant coatings having heavy metal toxicants, along with surrounding water through the cleaning deck 122 into the pre-processing deck 124. The surrounding water may be seawater, freshwater or another type of water depending on the environment in which the ship is docked. A flexible hose 123 may facilitate the transportation of the water entrained deposits from the cleaning deck 122 to the pre-processing deck 124. As will be outlined below, the pre-processing deck 124 treats the water entrained material, separating the particulate flow into a separator effluent and a liquid waste concentrate of crushed fouling material. The separator effluent is directed back towards the cleaning deck 122 via line 127. Line 127 may comprise an elongate flexible hose having a diameter of about 2 inches to 4 inches. The separator effluent may be reused to supplement further cleaning processes. Alternatively, the separator effluent may be discharged directly into the water. FIG. 1 shows line 130 through which the concentrate of crushed fouling material is transported to a land treatment unit 150, which may be located on a pier in the vicinity of where the ship is docked. The land treatment unit may also be situated on a ship such as a barge or on a platform or the like. Subsequent processing of the concentrate is performed in the land treatment unit. The line 130 may be a flexible hose of sufficient length and diameter, for example the hose may be about 400 feet to about 1000 feet in length, and about 1 inch to about 2 inches in diameter. Although the system 100 shows a ship hull 110, the cleaning vehicle 120 may be used to clean other submerged surfaces.

In the embodiment shown in FIG. 1B, the cleaning vehicle 120 moves across the hull surface 111 to physically remove fouling and other undesired buildups from hull surface. The removed material, which includes fouling and other cleaning material such as antifoulant coatings having heavy metal toxicants, along with surrounding water, is sucked in through a mouth of the cleaning vehicle by applying a reduced pressure gradient. The resulting particulate flow of liquid waste is discharged directly to the remote treatment unit 150, via the line 130 described above. Regarding the cleaning vehicle 120 shown in FIG. 1B, it should be noted that this vehicle may not necessarily be a single deck vehicle, but may have more than one deck. For example, the vehicle 120 of FIG. 1B may have a first deck that cleans and a second deck that is provided to control the cleaning process. Regarding the system 100 of FIGS. 1A and 1B, it should be noted that although FIGS. 1A and 1B show a ship hull 110, the cleaning vehicle 120 may be used to clean other submerged surfaces.

Figure 2A:
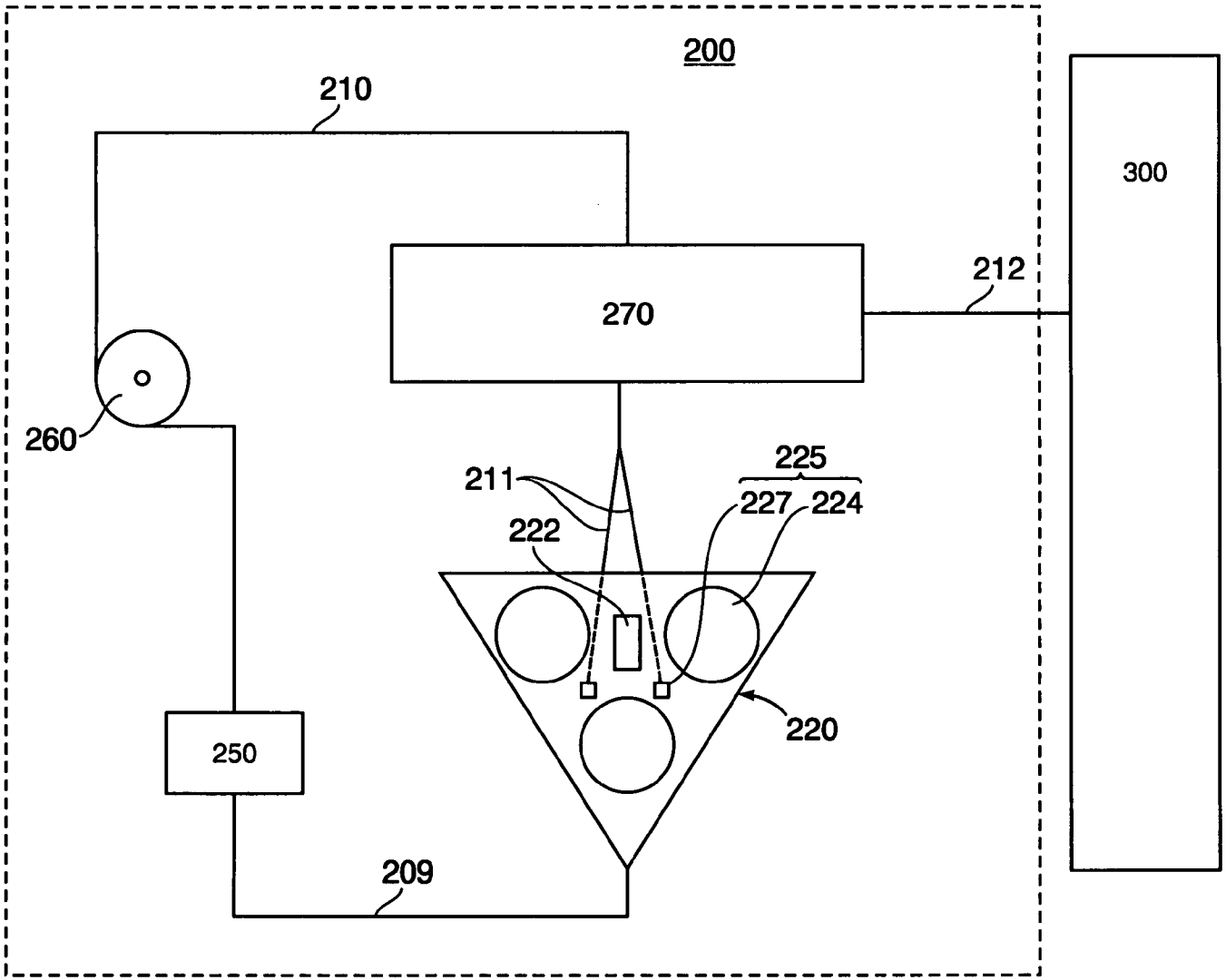
FIG. 2A is a schematic illustration of a cleaning vehicle for cleaning an underwater surface according to an embodiment of the invention.

FIG. 2A illustrates a cleaning vehicle 200 (within the dotted box) including a cleaning deck or shroud 220 as well as effluent treatment devices downstream of the shroud 220, for cleaning an underwater surface, such as a hull surface. FIG. 2A shows a schematic illustration of the elements of the cleaning vehicle 200 according to an embodiment of the invention. FIG. 2A shows the cleaning deck 220 having cleaning units 225, a solids-processing unit 250 downstream of the cleaning deck, a circulation and transfer pump unit 260, also downstream of the cleaning deck, which may be one or more pumps. The pump 260 is directly coupled to the solids-processing unit 250. The cleaning units may include one or more brushing devices and/or one or more nozzles. FIG. 2A also shows a separator unit 270 downstream of the solids-processing unit, which may be a hydrocyclone or similarly robust phase separator device. FIG. 2A also shows conduit lines 209, 210, 211, and 212. The conduit lines may be flexible hoses with line 209 connecting the cleaning deck 220 to the solids-processing unit 250, and line 210 connecting the circulation pump 260 to the separator unit 270. Line 211 also connects the separator unit 270 to the cleaning deck 220. As shown, line 211 is a split line that is connected to the nozzles 227. Line 212 connects the separator to a land treatment unit 300. The land treatment unit 300 may be located on a pier in the vicinity of the docked ship. Alternatively, the land treatment unit 300 may be situated on a ship such as a barge, or on another platform. Lines 209 and 210 convey a particulate flow from the cleaning deck to the separator unit, and line 211 conveys recycled separator effluents to the cleaning deck 220. The diameter of the lines 209, 210, 211, 212 may be adjusted to properly regulate flow-rates and maintain required pressure differences. For example, the diameter of the line 211 may be about 1.5 times the diameter of line 212, with line 211 having for example, a diameter of about 3 inches to about 4 inches and line 212 having a diameter of about 1.5 inch to about 2.5 inches, with line 210 having a diameter of about 3 inches, and line 209 having a diameter of about 4 inches. In one particular embodiment, lines 210 and 211 may have a diameter of about 3 inches and line 212 has a diameter of about 2.0 inches.

Figure 2B:
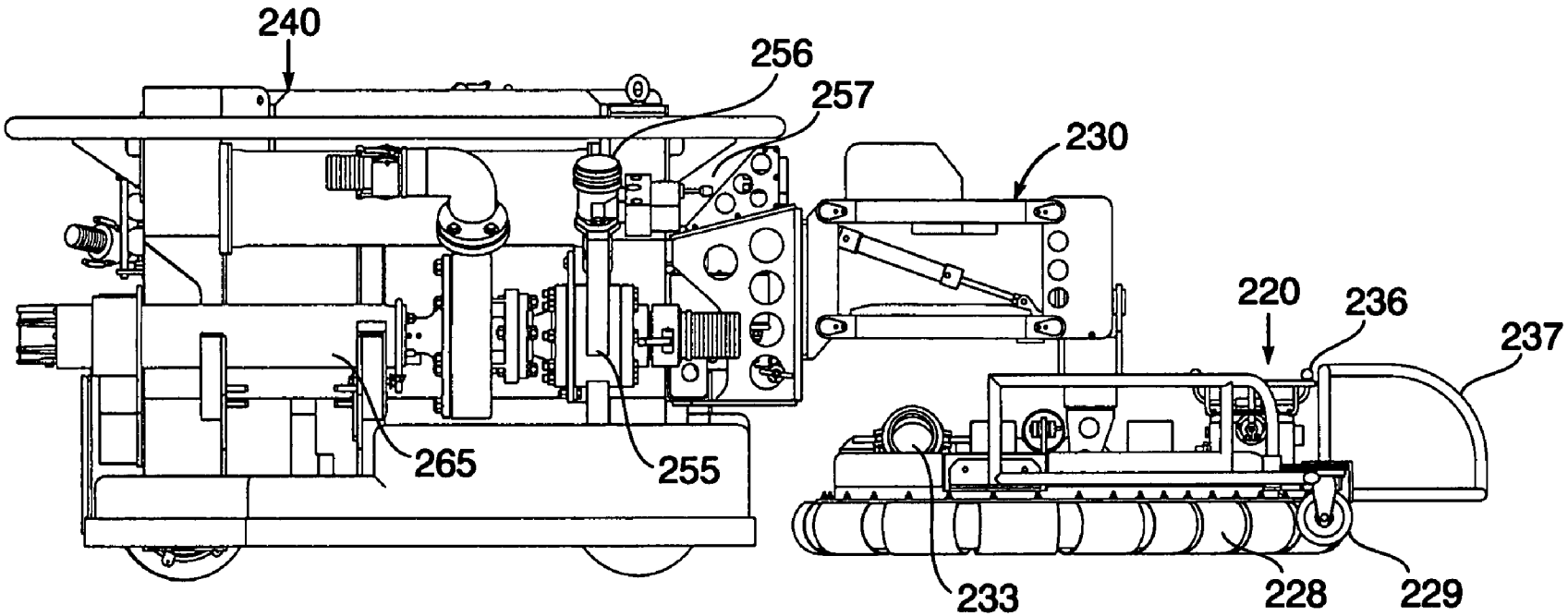
FIG. 2B is an exemplary side view illustration of a cleaning vehicle for cleaning an underwater surface according to an embodiment of the invention.
Figure 2C:
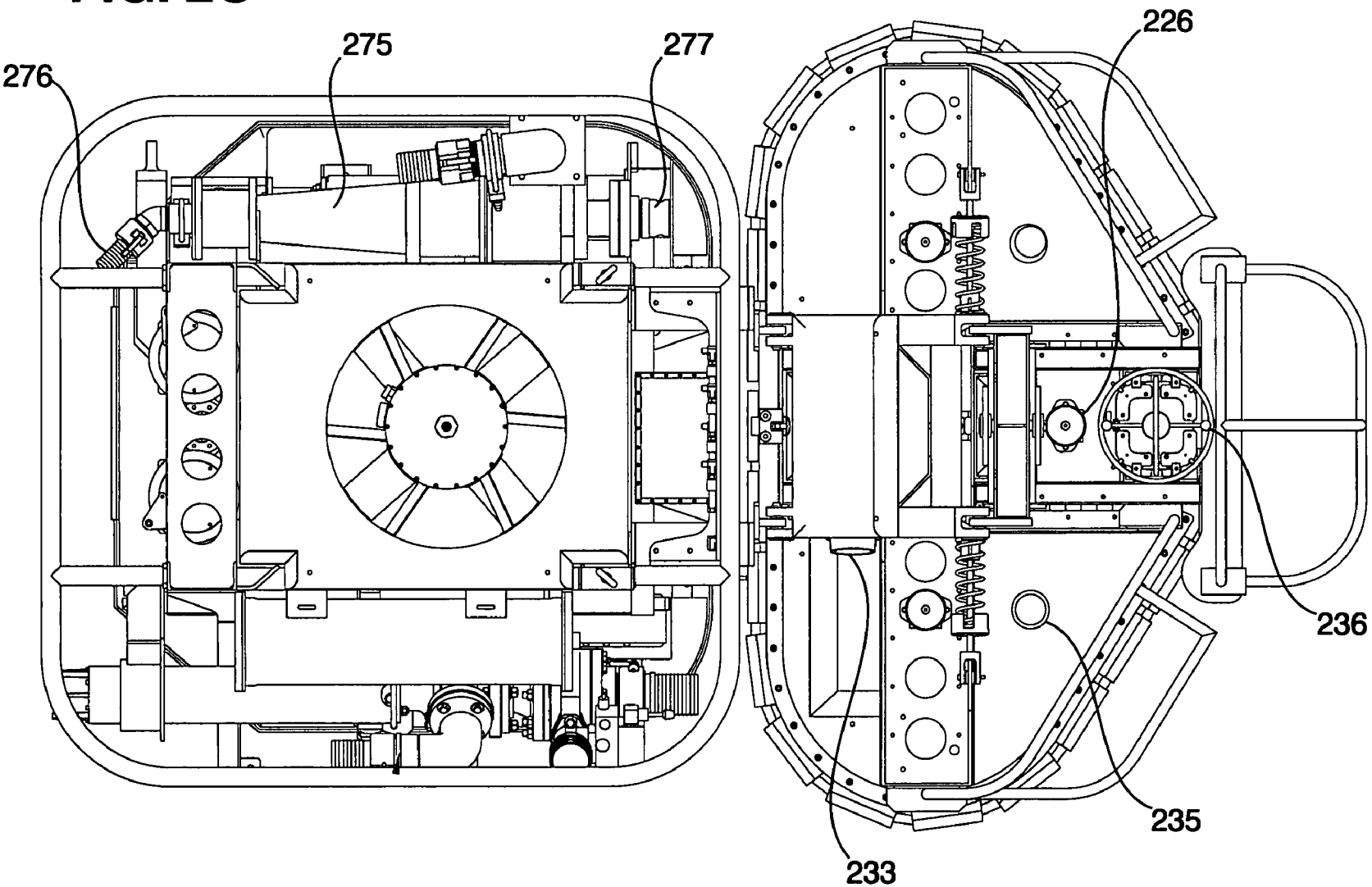
FIG. 2C is an exemplary top view illustration of a cleaning vehicle for cleaning an underwater surface according to an embodiment of the invention.

FIGS. 2B and 2C show side and top views respectively of the cleaning vehicle 200 according to an embodiment of the invention. FIGS. 2B and 2C show the arrangement of the various elements on the cleaning deck or shroud 220 and the pre-processing deck 240, as well as the arrangement of the cleaning deck 220 and the pre-processing deck 240 with respect to each other. FIG. 2B shows the cleaning deck 220 pivotally attached to the pre-processing deck 240 via a linkage member 230, which may allow for pivotal movement. The linkage member 230 may include a bar linkage arrangement to control the displacement of the cleaning deck 220 with respect to the pre-processing deck 240. FIGS. 2B and 2C show the cleaning deck having guide wheels 229, a diver control unit 236, and a guard/hand rail 237 to enable an operator to safely and properly control and maneuver the cleaning deck 220. As shown, the cleaning deck 200 also has a deck seal 228 to maintain a reduced-pressure contact with the hull surface. FIGS. 2B and 2C further illustrate a discharge port 233 for discharging the particulate flow, via a conduit such as 210 shown in FIG. 2A, from the cleaning deck 220 to the pre-processing deck 240. The top view of FIG. 2C shows recycling ports 235 for receiving recycled separator effluent/overflow, via a conduct such as 211 shown in FIG. 2A, from the pre-processing deck 240.

Figure 2D:
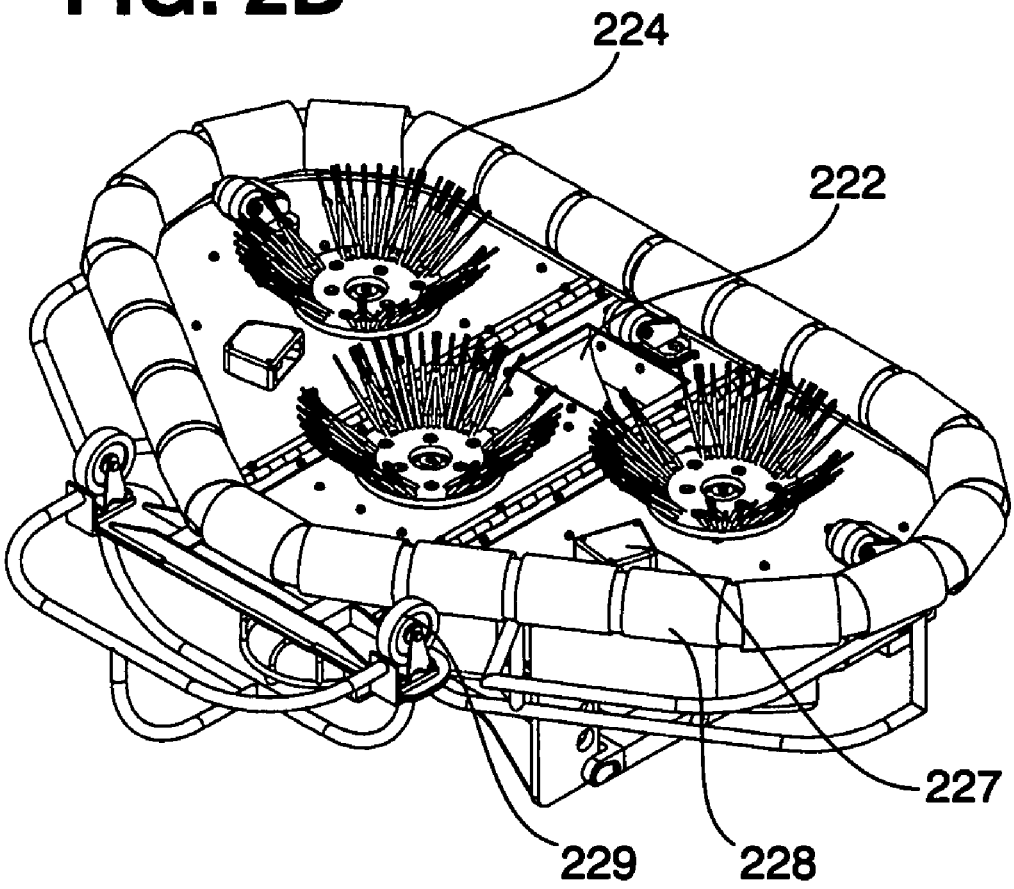
FIG. 2D is an exemplary illustration of a cleaning deck according to an embodiment of the invention.

FIG. 2D also shows the arrangement of the various elements on the cleaning deck 220 according to an embodiment of the invention. FIG. 2D shows deck suction mouth 222 for the intake of the particulate flow of water entrained fouling and other cleaning material. Also illustrated are reciprocating or rotating brushes 224. The brushes 224 may be arranged in a circular manner and may comprise of steel, polypropylene, combinations thereof, or any other material used for bristles in brushes. The brushes are powered by one or more brush motors 226, as shown in FIG. 2C. The FIG. 2D also shows discharge nozzles 227 for directing and discharging recycled separator effluent. The nozzles 227 are configured and positioned to direct the discharge so that the discharge flow flushes material and other material from the brushes 224. Additionally, the discharge flow from the nozzles 227 creates a water-current which directs into the deck mouth 222, material cleaned from the hull surface 111. Alternatively, the nozzles 227 may be directed to discharge the fluid directly onto the hull surface 111 to assist in the direct removal of fouling deposits. Although FIG. 2D shows three brushes 224, the cleaning deck 220 may contain as many brushes as desired, including less than three brushes or more than three brushes. Similarly, regarding the nozzles 227, the cleaning deck 220 may include as many nozzles as desired.

As stated above, the different elements of the pre-processing deck 240 are also shown in FIGS. 2B and 2C. FIG. 2B shows the deck 240 having a solids-processing unit, which is a crusher 255. FIG. 2B also shows the crusher motor 256 and crusher control lever 257 for operating the crusher 255. The crusher 255 crushes and fractures solids removed during cleaning to for example about ⅜-in or smaller, while having minimal impact on flow. Incoming solids to be processed can be significant in size, for example as large as 4 inches. FIG. 2B also shows a circulation pump 265, which may have a drive of about 30 HP. The pump 265 initiates the flow needed to generate shroud suction, the particulate flow of water entrained material, and subsequent downstream pressures for solids separation, separator fluid discharge or reuse, and concentrate transport.

FIG. 2C shows the pre-processing deck 240 having a separator unit, a hydrocyclone 275. The hydrocyclone 275 separates, concentrates and partitions the water entrained material into a separator effluent or overflow and concentrate or underflow streams. FIG. 2C also shows the deck 240 having an underflow discharge port 276 that discharges the concentrate towards the land treatment unit 300, and overflow discharge port 277 that discharges/recycles the separator effluent to the shroud 220.

Figure 2E:
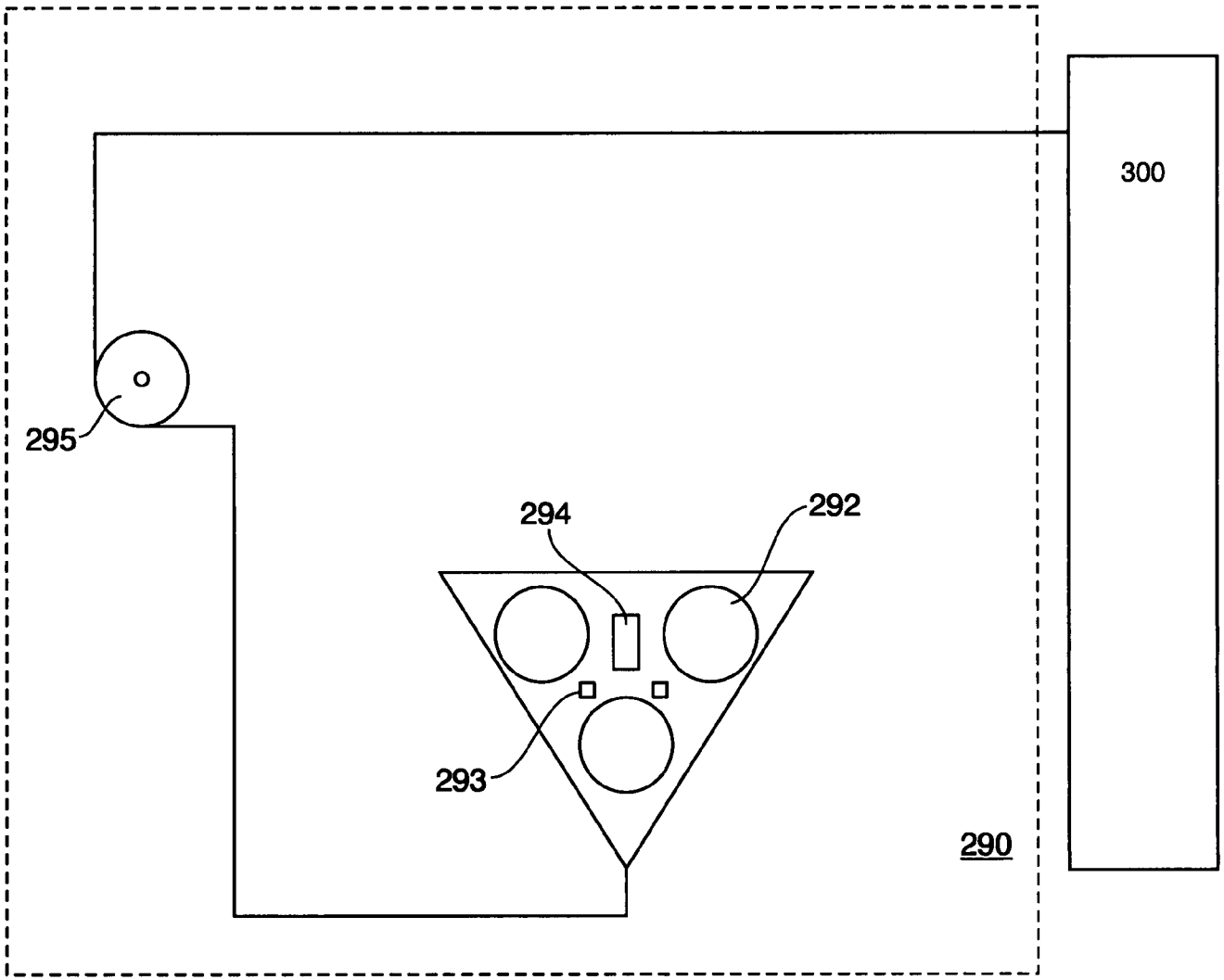
FIG. 2E is a schematic illustration of a cleaning vehicle for cleaning an underwater surface according to an embodiment of the invention.

FIG. 2E is a schematic illustration of a cleaning vehicle 290 (within dotted box) for cleaning an underwater surface according to an embodiment of the invention similar to the system of FIG. 1B, wherein the cleaning vehicle is designed to clean, but does not directly treat any of the cleaning effluents. As shown in FIG. 2E, the cleaning vehicle 290 includes a cleaning deck or shroud 291 that has movably mounted brushes 292 for cleaning the underwater hull surface. The shroud 291 may optionally include nozzles 293 for supplementing the cleaning action of the brushes. A deck mouth 294 is also provided on the shroud 291. As illustrated, the cleaning vehicle 290 also includes a pump 295. The pump 295 may have a drive of about 30 HP, and initiates a reduced pressure through the deck mouth 294 to generate proper shroud suction between the shroud 291 and the hull surface to enable the cleaning operation. In this embodiment, the pump 295 also sucks through the mouth 294, liquid waste which comprises the particulate flow of water entrained material and other removed materials from the hull. The liquid waste sucked through the shroud is pumped to the land treatment unit for processing.

It should be noted that brushes 292, the optionally included nozzles 293, and the deck mouth 294, are of similar structure to similar elements shown in FIG. 2D. Cleaning vehicle 290 may comprise a single deck structure or a multiple deck structure. For example, the vehicle 290 may have a first deck that cleans and a second deck that is provided to control the cleaning process. In a single deck structure, the pump 295 may be situated on the single deck. In a two deck structure, the pump 295 may be located on any of the deck structures.

Figure 3A:
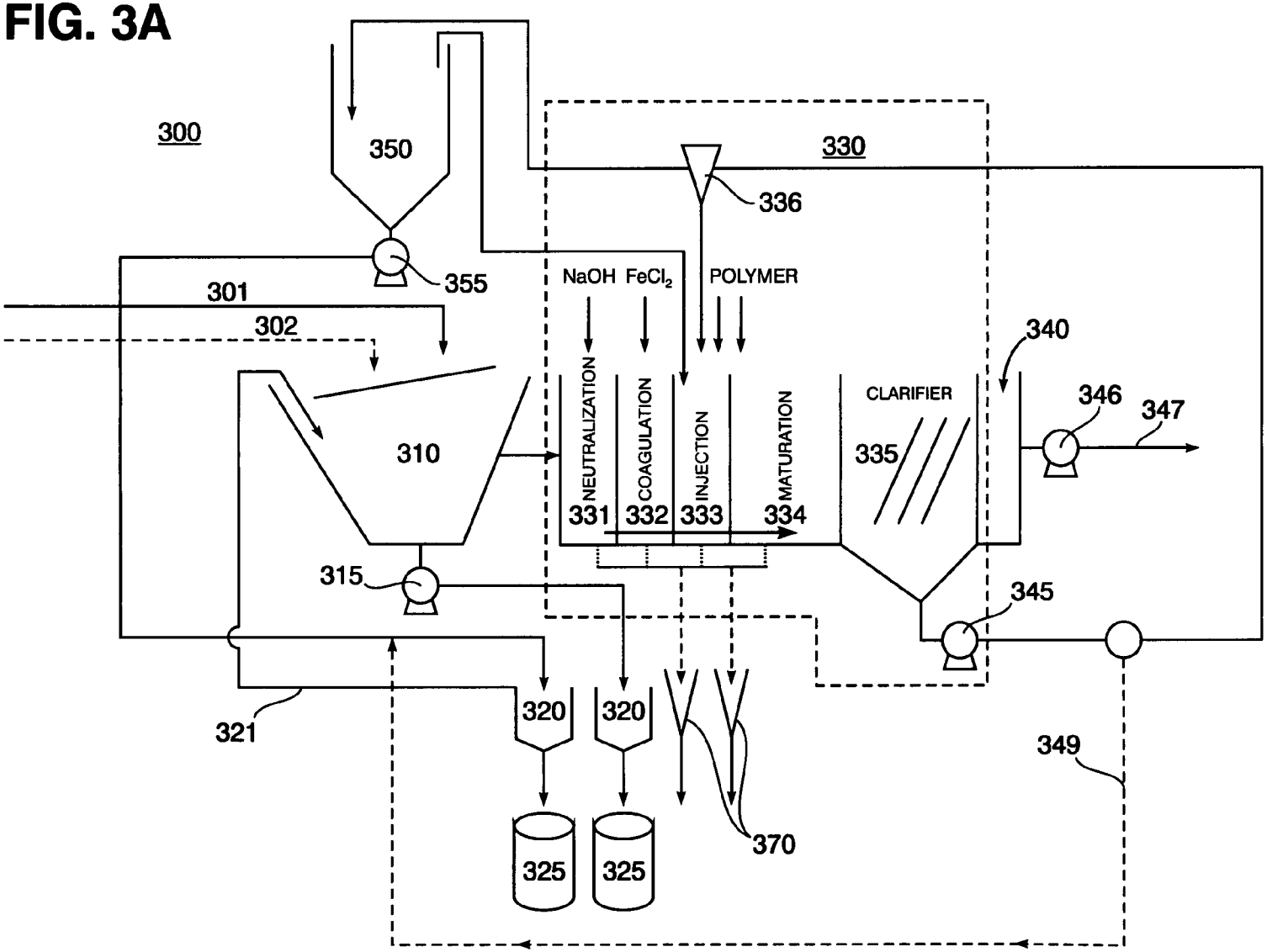
FIG. 3A is an exemplary flow diagram of a land treatment unit according to an embodiment of the invention.

FIG. 3A is an exemplary flow diagram of a land treatment unit 300 according to an embodiment of the invention. As shown, liquid waste enters the land treatment unit 300 from the cleaning vehicle via line 301. The liquid waste may either be a concentrate of crushed material, when the cleaning vehicle includes a pre-processing unit as illustrated in FIG. 2A. Alternatively, the liquid waste may be the untreated water entrained material that is sucked in by a cleaning vehicle as illustrated in FIG. 2E. The liquid waste may be pumped to the land treatment unit 300 at a rate of about 40 gallons per minute to a rate of about 100 gallons per minute, with a preferred rate of about 50 gallons per minute to about 60 gallons per minute. The unit 300 further includes a dispersion plate 305 and a primary settling tank 310 for the gravitation settling and separation of dense and more easily separable sludge from the liquid waste. In the settling tank 310, the dense and more easily separable solids descends downwards under the influence of gravity to the bottom of the tank. A pump 315 pumps the sludge to one or more hoppers 320 where sludge is dewatered and metered. As shown in FIG. 3A, the dewatered sludge is deposited into one or more drums 325, and overflow is redirected, via line 321, to the settling tank 310 to be re-processed.

As shown in FIG. 3A, the overflow of less dense liquid waste from the settling tank 310 is directed to the chemical treatment unit 330 (enclosed in dotted lines). As illustrated, the chemical treatment unit 330 includes a neutralization chamber 331, a coagulation chamber 332, an injection chamber 333, a maturation chamber 334, and a clarifier 335. The chemical treatment unit also includes a sand recirculation pump 345 and a hydrocyclone 336.

In the neutralization chamber 331, neutralizing chemicals such as sodium hydroxide are added to the liquid waste overflow to neutralize the waste. In the chemical co-precipitation chamber or coagulation chamber 332, coagulants such as ferric chloride are added and mixed in a preferable rapid mix zone to ensure good coagulant dispersion. In the injection chamber 333, ballasting sand and polymer are added to improve flocculation. Following the addition of sand and polymer in the injection chamber 333, the flow is passed to a slow mix zone, maturation chamber 334, to promote stable floc formation. The flocculated mixture is then passed to the clarifier chamber 335 for solid/liquid separation. The clarified effluent is collected in the effluent tank 340. From the effluent tank 340, clarified effluent is pumped by effluent pump 346, via line or hose 347, to either a public owned treatment works or other asset for final processing and discharge. Recirculation pump 345 pumps solids settled at the bottom of the clarifier 335 to the hydrocyclone 336. In the hydrocyclone 336, the sludge is separated from the sand. The reclaimed sand is reintroduced into the sand and polymer injection chamber 333 while the captured sludge is diverted to the sludge thickening unit 350 for further processing.

In the sludge thickening unit 350, polymers are added to thicken the sludge, prior to slow stirring. Pump 355 then pumps the thickened sludge to hoppers 320 for dewatering. Although FIG. 3A shows the use of hoppers 320 to perform the dewatering process, other dewatering systems may be substituted or used in a complementary manner. For instance, a rotary press or other filtration system may be used.

The land treatment unit 300 is designed to operate in both manual and fully automated modes, operating in fill, start and shut-down (daily and final) sequences. In shutdown mode, the intake of liquid waste from the cleaning vehicle is terminated and substituted with relatively clean water, which may be surrounding water or hydrant/fire main water, to conduct final clean processing and flushing of the system. The intake of liquid waste may be stopped by design or due to sub-system failure, such as the underwater hull cleaning vehicle. The surrounding water or hydrant water enters the pier treatment unit via water intake line 302. In the shut-down mode, various tanks or subsystem are systematically eliminated from use, cleaned and isolated. The process includes a combination of solids partitioning and separation within the system followed by isolating primary clarifier 310, sludge thickening system 350 and finally, the chemical treatment module 330 itself prior to directing final contents of chemical treatment module 330 to bag filters 370, via a drain tank and pump to the discharge riser location. In the shut-down mode, slurry that had been separated in the clarifier is diverted back to the hopper along line 349, as shown in FIG. 3A.

Figure 3B:
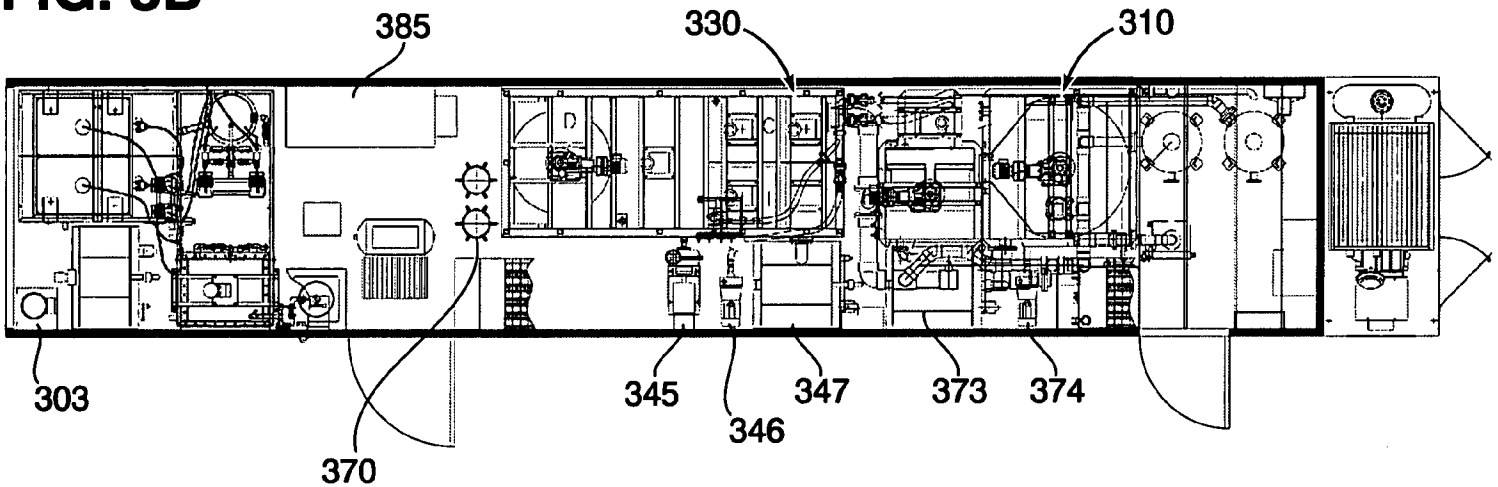
FIG. 3B is an exemplary top view illustration of a land treatment unit according to an embodiment of the invention.
Figure 3C:
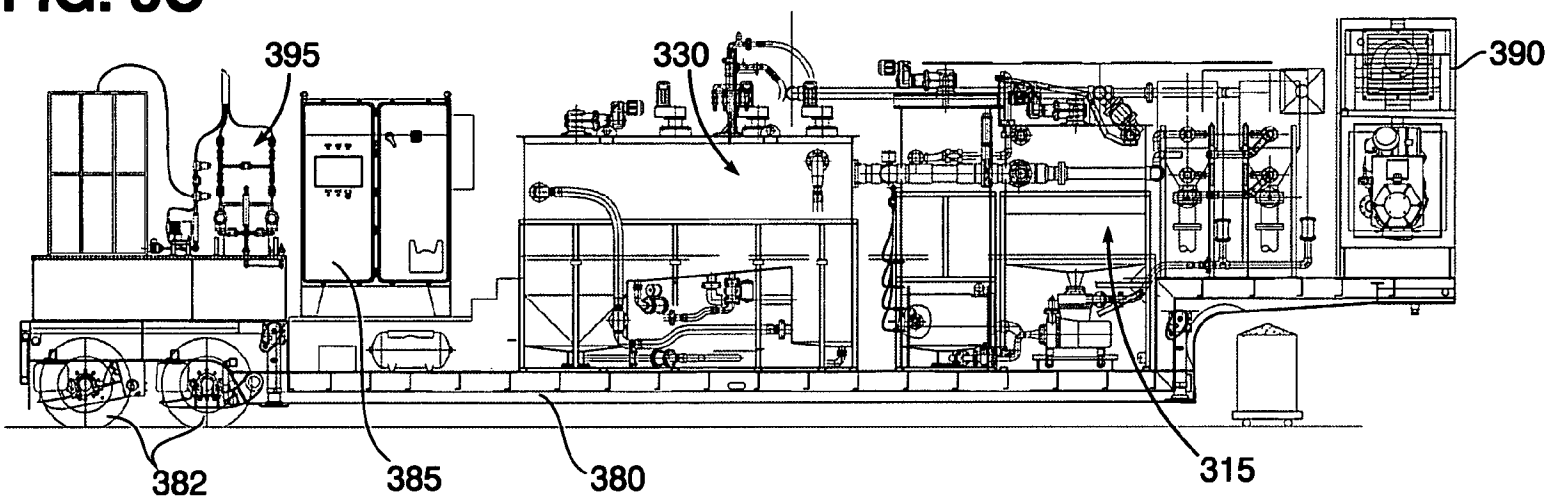
FIG. 3C is an exemplary side view illustration of a land treatment unit according to an embodiment of the invention.

FIGS. 3B and 3C are exemplary top and side views, respectively, of a land treatment unit 300 according to an embodiment of the invention. More specifically, FIGS. 3B and 3C show the arrangement of various elements of the land treatment unit 300 with respect to each other. In addition to the elements outlined in detail above with respect to FIG. 3A, the top view of FIG. 3B shows the unit 300 having a hydraulic pump unit 303 for energizing a submersible pump and drawing surrounding water into the system for operating in the vehicle discharge failure or shut-down mode. As outlined above, the clean water is typically drawn from surrounding water but during final shutdown may be obtained from a hydrant. FIG. 3B also shows control panel 385 for controlling the overall operation of the land treatment unit 300. FIG. 3B also shows drain pump 374. The side view of FIG. 3C shows the unit mounted in a mobile trailer 380. FIG. 3C also shows an automatic leveling system 382 for maximizing the flow and operation of the filtration systems of unit 300. Also illustrated in FIG. 3C is a power generator 390 and a chemical storage and polymer mixing, maturation, storage and injection systems 395.

This above-described apparatus enables integrated removing, capturing, containing, collecting, comminuting, separating, concentrating, discharging/reusing and transporting of hull cleaning wastewater from a moving vehicle, stationary platform or other submerged, partially submerged or floating base. The principal components and process may comprise an advanced waterborne underwater hull-cleaning vehicle. An environmentally friendly method of cleaning an underwater hull surface and treating cleaning effluents is outlined below.

Figure 4:
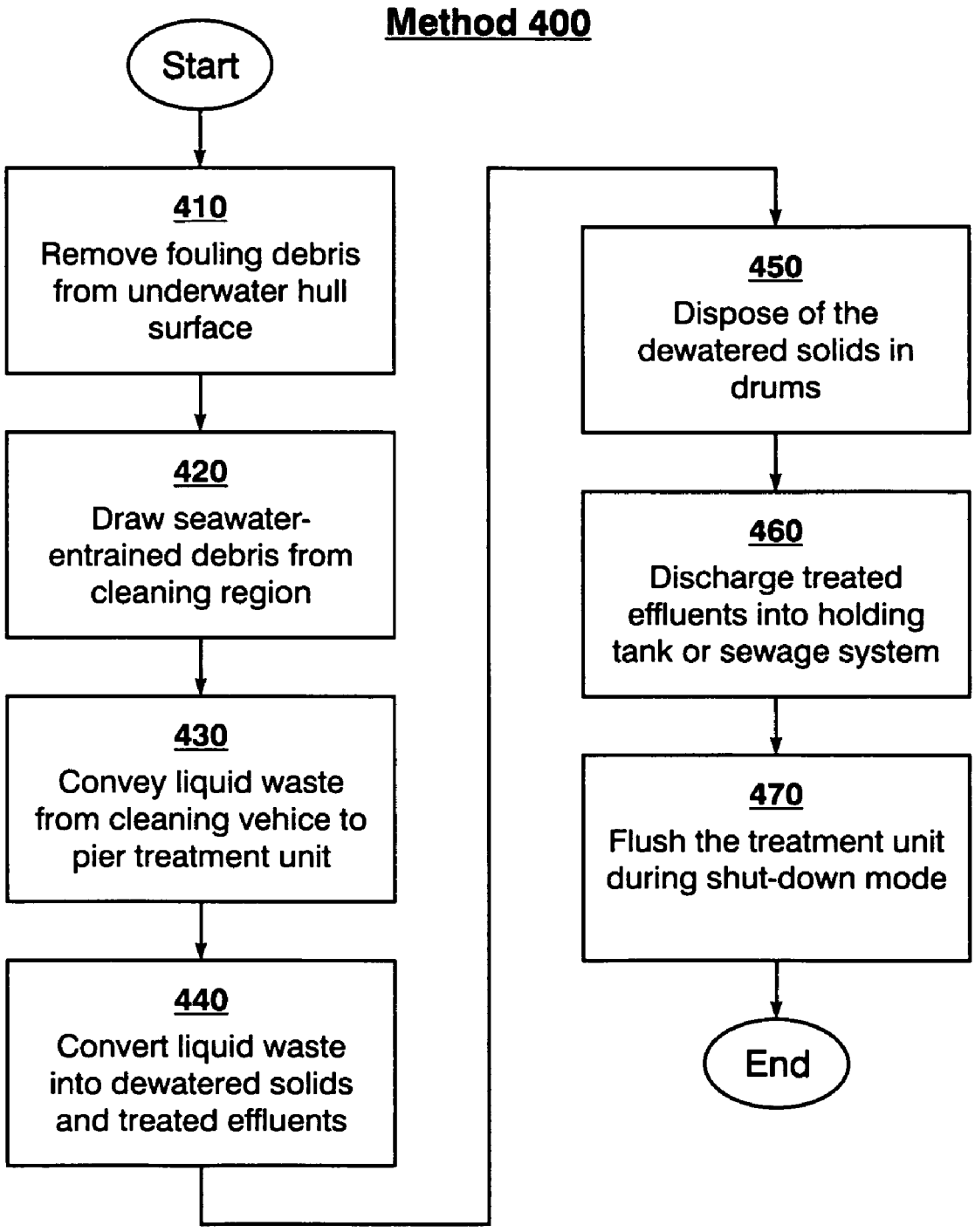
FIG. 4 is a flowchart of a method of cleaning an underwater hull surface and treating cleaning effluents according to an embodiment of the invention.

FIG. 4 is a flowchart showing an environmentally friendly method of cleaning an underwater hull surface. Step 410 is the removing of fouling material from the underwater hull surface. The material is removed by the shroud of the cleaning vehicle, which contacts the underwater hull surface. Step 420 is the drawing of a particulate flow of water entrained material from the cleaning region. As shown in FIGS. 2A and 2E, the cleaning vehicle includes a pump, which draws through the mouth of the shroud, removed fouling material as well as other material, such as antifoulant coatings removed from the cleaned surface. The material is sucked in along with water located in the cleaning region.

Step 430 is the conveying of liquid waste from the cleaning vehicle to the land treatment unit. The liquid waste is transported to the land treatment unit via a flexible hose of about 600 feet. The hose may have a diameter of about 1.5 inches to about 2.5 inches, depending on the consistency of the liquid waste. If the cleaning vehicle is one that includes a pre-processing unit as outlined with respect to FIG. 2A, then the water entrained material is processed before it is transported to the land treatment unit. Consequently, the liquid waste comprises a processed form of the particulate flow of water entrained material. If the cleaning vehicle is one that does not include a per-processing unit as outlined with respect to FIG. 2E, then because there is no pre-treatment of the particulate flow, the liquid waste transported to the land treatment unit is actually the particulate flow of water entrained material.

Step 440 is the converting of the liquid waste into dewatered solids and treated effluents. As outlined in FIG. 3A, the land treatment unit utilizes gravity settling, chemical treatment with chemical co-precipitation, and gravity thickening, to produce dewatered solids and cleaner treated effluents. The system may also include rotary press or other technologies to perform solids separation and dewatering functions. Step 450 is the disposing of the dewatered solids into drums or other appropriate containers. Step 460 is the discharging of treated effluents into a holding tank or to a sewage system for further treatment. Steps 450 and 460 are outline in the description of FIG. 3A.

Step 470 is the shut down and flushing of the pier treatment unit. As outlined with respect to the explanation of FIG. 3A, the flushing includes the step of shutting off the supply of liquid waste from the cleaning vehicle. The shutting off of the supply of liquid waste may be intentionally done during shut down or may occur unintentionally during operation due to system malfunction. During shut-down alternate supply water is used for flushing that further includes the steps of pumping either surrounding water or hydrant water into the pier treatment unit via the water intake port, directing the water into the chemical treatment module, and filtering through the one or more bag filters, the final, treated contents of the unit. Step 470 may also include the discharge of filtered liquids, via the drain pump.

What has been described and illustrated herein are preferred embodiments of the invention along with some variations. The terms, descriptions and figures used herein are set forth by way of illustration only and are not meant as limitations. For example, method steps may be performed in different orders. Those skilled in the art will recognize that many variations are possible within the spirit and scope of the invention, which is intended to be defined by the following claims and their equivalents, in which all terms are meant in their broadest reasonable sense unless otherwise indicated.

What is claimed:

1. An integrated cleaning and treatment system comprising:

a waterborne cleaning vehicle for removing fouling from an underwater surface of a docked watercraft and for drawing water entrained material away from a cleaning region, the waterborne cleaning vehicle comprising:

a cleaning deck for removing the fouling from the underwater surface, the cleaning deck having a deck mouth; and at least one pump operatively connected to the cleaning deck, generating suction and creating through the deck mouth, a particulate flow of water entrained fouling material removed by the cleaning deck and to pump the water entrained fouling material to the land treatment unit;

a land treatment unit for treating liquid waste received from the cleaning vehicle and converting the liquid waste into dewatered solids and treated effluents, wherein the liquid waste is either a treated or untreated particulate flow of entrained material removed by the cleaning deck, the land treatment unit comprising:

a gravity settling unit;

a chemical treatment unit; and a sludge thickening unit; and a land intake hose having a first end and a second end, the first end attached to the cleaning vehicle and the second end attached to the land treatment unit, the land intake hose transporting the liquid waste from the cleaning vehicle to the land treatment unit.

2. The integrated cleaning and treatment system of claim 1, further comprising:

a water intake line for receiving either water or hydrant water for flushing the land treatment unit during shutdown;

one or more bag filters for filtering flushed particles during shutdown; and a drain pump for discharging filtered water during shutdown.

3. The integrated cleaning and treatment system of claim 2, wherein the chemical treatment unit comprises:

a neutralization chamber;

a coagulation chamber;

an injection chamber;

a maturation chamber; and a clarifier.

4. The integrated cleaning and treatment system of claim 3, wherein the land intake hose has a diameter of about 2 inches, and a length of about 600 ft.

5. The integrated cleaning and treatment system of claim 3, wherein the cleaning vehicle further comprises:

a pre-processing deck for the treatment and conversion of the particulate flow into the liquid waste and a separator effluent before the liquid waste is pumped to the land treatment unit.

6. The integrated cleaning and treatment system of claim 4, wherein the land treatment unit is mounted on one or more mobile trailers.

7. The integrated cleaning and treatment system of claim 6, wherein the land treatment unit further comprises:

an effluent hose; and an effluent pump, wherein the effluent pump is operably connected to the effluent hose for pumping treated effluents from the land treatment unit via the effluent hose.

8. The integrated cleaning and treatment system of claim 5, wherein the pre-processing deck comprises:

a crusher for crushing and fracturing solids; and a separator that concentrates and partitions the water entrained material into the separator effluent and the liquid waste.

* * * * *